United States Patent [19]

Bannister Hatcher

[11] 3,952,989

[45] Apr. 27, 1976

[54] ADJUSTABLE READING MATERIAL STAND

[76] Inventor: Constance L. Bannister Hatcher, P.O. Box 8, Syosset, Long Island, N.Y. 11791

[22] Filed: Nov. 26, 1974

[21] Appl. No.: 527,253

[52] U.S. Cl. ..... 248/453; 248/452; 248/454; 248/460

[51] Int. Cl.[2] ..... A47B 97/04

[58] Field of Search.... 248/441, 443, 444, 446–448, 248/449, 451, 452, 453, 454–457, 460, 463, 464

[56] References Cited

UNITED STATES PATENTS

| | | | |
|---|---|---|---|
| 556,579 | 3/1896 | Leach et al. | 248/452 |
| 2,003,746 | 6/1935 | Headington | 248/452 |
| 2,549,306 | 4/1951 | Greene | 248/460 X |
| 2,570,439 | 10/1951 | Forca | 248/452 |
| 2,834,149 | 5/1958 | Flahive et al. | 248/445 |
| 3,031,795 | 5/1962 | Frost | 248/452 |
| 3,863,882 | 2/1975 | Hatcher | 248/453 |

FOREIGN PATENTS OR APPLICATIONS

| | | | |
|---|---|---|---|
| 329,011 | 11/1920 | Germany | 248/453 |

*Primary Examiner*—James T. McCall
*Assistant Examiner*—Terrell P. Lewis
*Attorney, Agent, or Firm*—Peck & Peck

[57] ABSTRACT

A device for facilitating the holding of reading material for easy reading, freeing the reader's hands for any desirable work. The device consists of an upstanding backing member against which the binding of the book or other reading material is supported and in combination with this backing, I provide a base support for the reading material. Upstanding from this base support is a spaced apart pair of page supports and cooperative with these upstanding members is a pair of biased fingers one being provided for each page support, these fingers being independently operable. The fingers are biased towards the page members. The device also includes means whereby the backing member, the reading material base support and the upstanding page supports are adjustable to vary the angle of the reading material relative to the horizontal. When the above mentioned members are adjusted to various positions, the biased fingers continue to be in releasable engagement with the page supports. Two pairs of arms are provided, one extends forwardly from said means and the other extends rearwardly therefrom and extending between and mounted for swiveling motion on each pair of arms is a leg member adapted to support the device in the various adjusted positions. The pairs of arms are pivotally mounted on said means so that they may be pivoted upwardly or downwardly as desired to thereby vary the height of the device and the reading material mounted thereon.

3 Claims, 5 Drawing Figures

ADJUSTABLE READING MATERIAL STAND

BACKGROUND OF THE INVENTION

This invention relates to a device for holding reading material in desirable and easy reading position leaving the reader's hands free for other duties if desired.

While I am aware that stands for supporting reading material have been devised, such prior art stands are not endowed with the highly advantageous and desirable characteristics which are inherent in the stand disclosed herein.

Prior art stands, of which I am aware, do not provide a conveniently operable mechanism for holding the pages of the reading material in proper position and for releasing a page for turning thereof as the reading proceeds.

Within may knowledge, known stands for supporting reading material do not include a variety of adjusting axes so that the components of the stand may be adjusted and maintained in various relative positions to each other and to the reader to facilitate and make the reading of the material much easier and more pleasant.

This device is adaptable for support on the lap of the reader whether in sitting position or reclining in bed.

SUMMARY OF THE INVENTION

It is common knowledge that the visions of all persons differ, the light varies in different rooms and positions and also the print of reading material is not always uniform. In order to accommodate such variations and others, the adjustable reading material stand support which I have devised is ingenious in its arrangement whereby the position of the reading material may be varied at will to different positions from the vertical. The height of the reading material from the page upon which the support rests may be varied to accommodate the above mentioned variations in order to make the reading easier.

In order to adjust the various components of the support, in order to meet the varying conditions, the support comprises two horizontal axes of adjustability, one of said axes serving two adjusting functions.

The support of this invention is portable and may be easily adjustable to position to make it more compact and easily carried.

The reading material whether in the form of a hard or soft copy book, magazine or the like, is releasably mountable upon the support and operating means are provided for use when pages of the reading material are turned.

DESCRIPTION OF THE INVENTION

Figure 1:
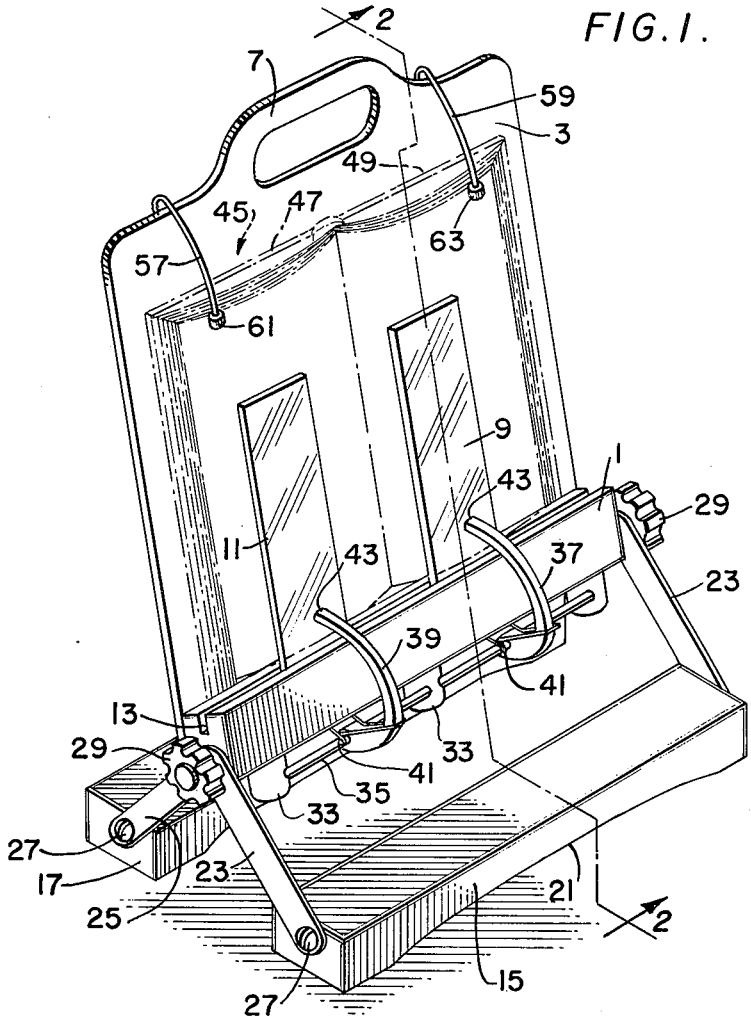
FIG. 1 is a front perspective view of the stand for supporting reading material.

The adjustable reading material stand of this invention comprises a reading material support member 1 which may be formed of any relatively light weight rigid material such as wood, plastic, or the like, and as will become apparent as this description proceeds is adapted to support the lower edges of the binding and leaves of a book. The stand includes an upstanding backing member 3 which is relatively rigid and may, if desired, be formed of the same material as is the reading support member 1. The upstanding backing member 3 is fixed to the rear surface of the reading material support member 1 to extend upwardly therefrom, as is clearly illustrated in the drawings. The width of the member 3 is substantially the same as the length of the member 1 and the member 3 may be fixed to the support member 1, in any suitable manner, as by screws 5. A handle 7 is provided at the upper end of the upstanding backing support member 3 to facilitate carrying the device.

Figure 3:
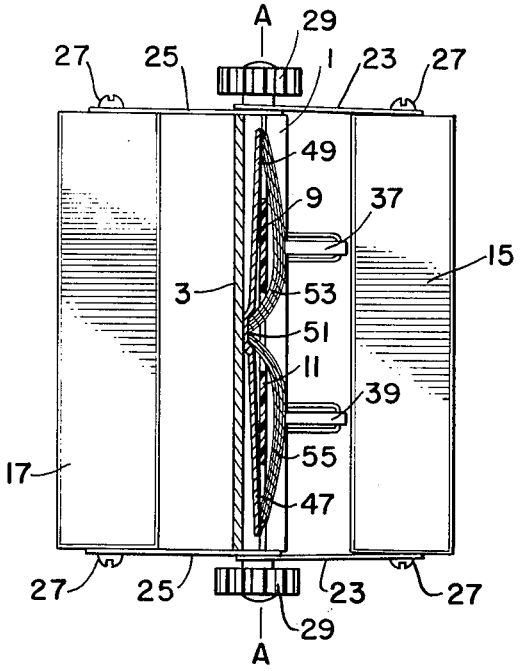
FIG. 3 is a view taken on the line 3—3 of FIG. 2.
Figure 4:
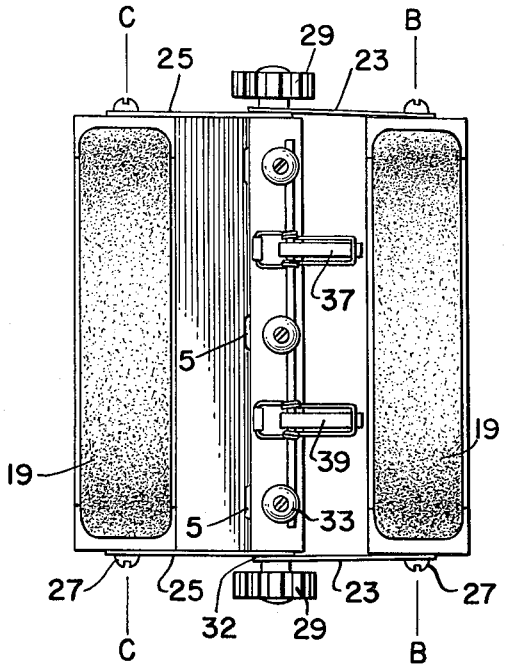
FIG. 4 is a bottom plan view of the support.

I provide a pair of book cover support members 9 and 11 which are fixed to and extend upwardly from the reading material support member 1. These members 9 and 11 are of generally rectangular configuration and are spaced forwardly from the upstanding backing member 3, as is clearly shown in FIG. 3 of the drawings. The members 9 and 11 may be formed of plastic or any other suitable material having a degree of rigidity so as to hold the book cover in proper position as will be described. While I have illustrated the members 9 and 11 as being fixed in a groove 13 which is formed in the upper surface of the reading material support member, it is to be understood this is merely by way of example and not to be construed as a limitation, for the members 9 and 11 may be attached to extend upwardly from the member 1 in any suitable manner. Consideration of the drawings will clearly indicate that the members 9 and 11 are spaced apart longitudinally with respect to the member 1 and it is clear that the width of the members 9 and 11 is substantially reduced relative to the length of the member 1. Members 9 and 11 are so positioned in relation to the book being held, that they serve as retainers preventing lateral movement along member 1, and preventing the book from forward movement.

In order to support the entire device from any base upon which it may rest, forward and rearward supporting legs 15 and 17, respectively, are provided. Each of these legs is preferably of elongated configuration of substantially the same length as the reading material supporting member 1. The legs 15 and 17 are formed of relatively rigid material which may be the same as that from which members 1 and 3 are formed and the underside of each leg 15 and 17 is preferably coated with felt or the like material and is of concave construction as illustrated at 21. This concave construction is designed to conform to the lap, thighs or stomach of the reader. The forward leg 15 is adjustably mounted, in a manner as will be explained, to the forward ends of a pair of links 23, while the rearward leg 17 is mounted to the device by mounting on the rear ends of a pair of links 25. One link of each pair of links 23 and 25 extends to an end of the legs 15 and 17, respectively, and are pivotally attached to said ends as at 27 so that the legs 15 and 17 may swivel on the pivot points 27 where the ends of the links are mounted on the ends of the legs. I provide a tension adjusting knob 29 at each end of the member 1, such knobs preferably being threadedly received in the ends of the member 1. Each link of the pairs of links 23 and 25 extend from their pivotal connection with the legs to loosely extend around the spindles 31 of the knobs 29, as at 32, so that by turning the knobs in one direction the ends of the links will be pressed between the ends of the member 1 and the knob so that their extending positions relative to the member 1 may not be changed. In order to permit an angular change of these links relative to the member 1, the knobs 29 are loosened.

Depending from the lower face of the reading material support member 1, are plurality of depending lugs 33 and a biased finger supporting rod 35 extends between these lugs and is fixed thereto. I provide a pair of arcuate shaped biased leaf or page engaging fingers 37 and 39. Each finger 37 and 39 is rotatably connected, in any suitable manner, at its lower end to the rod 35 and each finger is biased to be urged rearwardly of the device by means of any suitable spring biasing means 41. Each of the fingers 37 and 39 is curved or arcuately formed to extend forwardly from the rod 35 and then upwardly and rearwardly to provide a leaf engaging nose 43. Consideration of the drawings clearly indicates that the finger 37 coacts with the member 9 while the finger 39 coacts with the member 11 and since each finger is spring biased rearwardly the noses 43 will be in engagement with the members 9 and 11 when no reading material is supported on the reading support member 1. It is to be distinctly understood that it is within my contemplation to use various means for mounting the fingers, and the lug and rod arrangement which is illustrated in the drawings is merely by way of example and not to be construed as a limitation.

In order to position reading material in operative position on the stand, the binding which I have designated generally by the numeral 45 comprises the front cover 47 and the back cover 49 of the reading material. The binding 45 of the work is supported at its lower edges upon the reading material support member 1 and the binding extends upwardly therefrom and is supported by the upstanding backing member 3, and behind members 9 and 11, as is clearly shown in FIG. 3 of the drawings. With the work so positioned and supported, it will be evident that the center strip 51 is positioned between the members 9 and 11 and the leaves or pages of the book which are bound into the binding at the center strip thereof are brought forwardly between the members 9 and 11 and then positioned to extend over the front or forward surfaces of these members, as is clearly shown in FIG. 3 of the drawings as at 53 and 55. With the work so mounted, the pages 53 and 55 of the work being extended in front of and across support members 9 and 11 will be releasably maintained in such positions by means of the fingers 37 and 39, the noses 43 of which will be in engagement with such pages.

As the reader scans the reading material upon the pages of the work and when it is desired to turn a page, it is merely necessary to pull the finger 37 forwardly against the biasing action of the spring 41 and then manually grasp the page which it is desired to turn and move the page toward the member 11 releasing the finger 37 to engage and hold the next page. The finger 39 is now pulled forwardly against the biasing action of its spring 41 so that the page which has been turned may be maintained against the member 11 by the action of the nose 43 of the finger 39, the finger 39 having been released after the turned page is in position against the member 11.

My experience in this art indicates that in the reading of certain types of reading material, it may be desirable to releasably maintain the pages in position by applying additional releasable pressure adjacent the tops of such pages. In order to accomplish this, I have provided a left hand spring element 57 and a right hand spring element 59 which are anchored, as at points 61, to the back surface of the upstanding backing member 3 and extend thereover and downwardly with respect and over the forward surface of the member 3, their working noses 61 and 63 engaging the pages 53 and 55 of the reading material. The elements 57 and 59 are formed of flexible steel wire or the like so that in turning the pages of the work, they may be grasped to lift and release a page. In the use of a device which involves the elements 57 and 59, the manner of releasing these elements in the turning pages is generally the same as that followed in the use of fingers 37 and 39.

One of the highly advantageous characteristics of this invention resides in its adjustability so that the height of the stand, and consequently the reading material supported thereon, may be varied as well as the angle of the reading material support means which may be adjusted to various angles relative to the vertical. It is also significant that the angular positions of the legs may also be changed to accommodate their support on various bases and also to further increase the height of the stand and its reading material.

Figure 2:
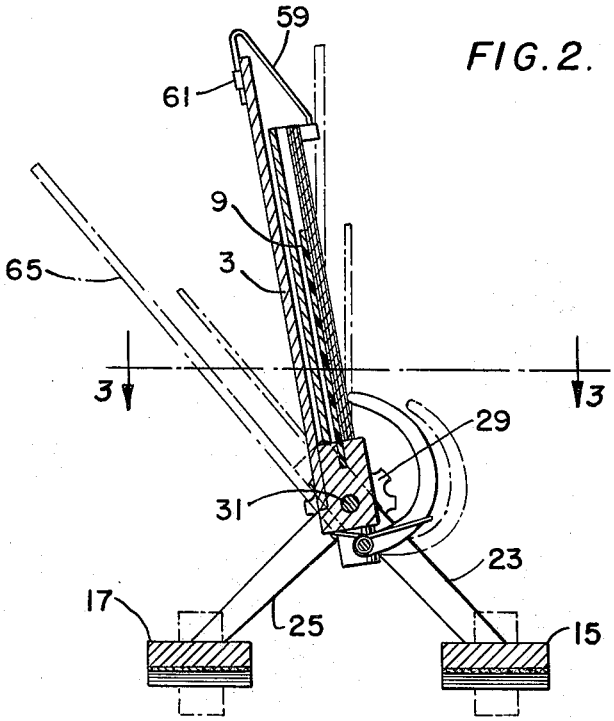
FIG. 2 is a view taken on the line 2—2 of FIG. 1.

I provide an axis A—A by means of which the position of the backing member 3, the reading material support member 1 and thus the reading material may be adjusted relative to the vertical. This is accomplished merely by moving the backing member 3 either forwardly or rearwardly so that it will pivot on the spindles of the knobs. One adjusted position of these components is illustrated in FIG. 2 of the drawings. A greater angular variation of the compoentns is illustrated in phantom lines at 65 in FIG. 2. This axis A—A is also utilized by the knobs 25 to vary the angular relationship of the links 23 and 25 relative to the reading support member 3. Thus, this angle of inclination of these link members will cause a variation in the distance between the reading support member 1 and the leg 15 and 17 to thereby make possible the adjustment of the height of the backing member and base support member and consequently the reading material. Two further axes of adjustment are provided, these are B—B and C—C. It will be understood that the legs 15 and 17 are pivotally mounted to the outer ends of the links so that their positions may be changed to accommodate various bases upon which the device may be supported and also in the event that further height is desired, the legs may be pivoted on their pivotal mountings so that an edge 67 of a leg rests upon the base upon which the device is mounted to thereby further increase the height of the reading material.

Figure 5:
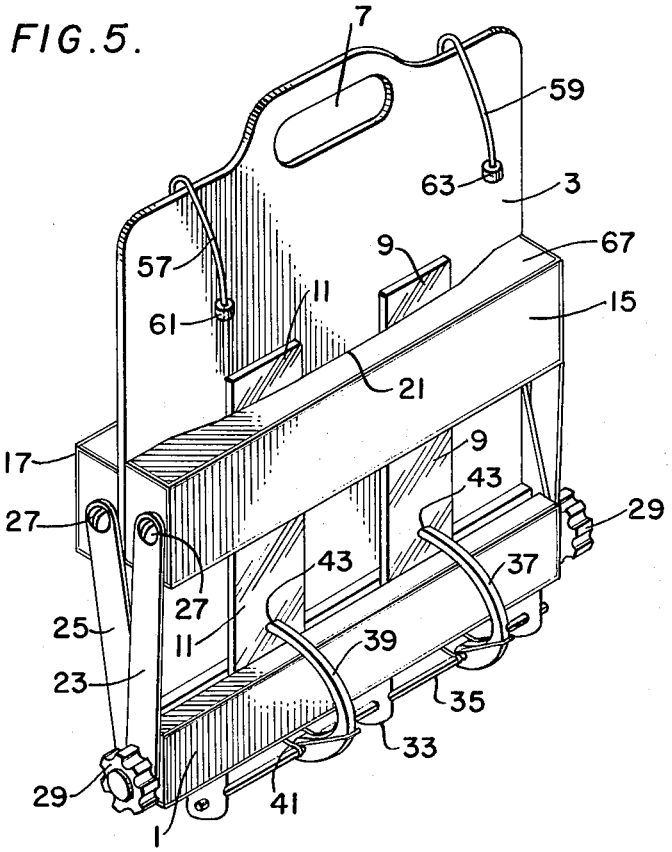
FIG. 5 is a perspective view illustrating the stand in collapsed position for ease of storage or carrying.

Consideration of FIG. 5 of the drawings illustrates how this portable carrying stand may be easily collapsed for the facilitating the storage or carrying thereof. It will be seen how the legs 15 and 17 are moved upwardly against the support members 9 and 11 and against the rear surface of the backing member, respectively, this collapsing operation being accomplished by loosening the knobs 29 so that the legs may be moved into collapsed position and then tightening the knobs 29 to releasably maintain the legs in this collapsed position.

What is claimed is:

1. A portable reading material stand including, in combination, a base for supporting the reading material along its lower edges, a back member fixed to and upstanding from said base, spaced apart means fixed to and extending upwardly from said base and spaced forwardly from said backing member and adapted to maintain the binding of the reading material between the upstanding backing member and said spaced apart means, the pages of the reading material when in readable position extending across the front surfaces of said spaced apart means, a pair of fingers operatively mounted from said base, said fingers being movable relative to said spaced apart means and coacting with said spaced apart means and the pages extending thereacross, each of said fingers being biased toward said spaced apart means for releasable engagement with the pages of the reading material, and legs provided for supporting said base, one of said legs extending forwardly from said base and in operative base supporting position being outside the vertical plane of the base and the other of said legs extending rearwardly from said base and in operative base supporting position being outside the vertical plane of the base, a pair of leg supporting arms extending forwardly from said base and a further pair of leg supporting arms extending rearwardly from said base each pair of arms being of the same length, each leg supporting arm of said pairs of legs supporting arms being adjustably mounted at the ends of said base for varying the angle of inclination of the legs supporting arms with respect to said base, and each leg extending between and pivotally mounted at each end to a pair of legs supporting arms.

2. A portable reading material stand in accordance with claim 1, wherein each of said fingers is operatively mounted and supported on finger supporting means spaced below said base member and each of said fingers is of arcuate configuration and extends forwardly and upwardly with respect to the front surface of said base and spaced therefrom, and then extends rearwardly upwardly with respect to the front surface of said base but spaced therefrom to releasably engage said spaced apart members and the pages of the reading material which extend thereacross.

3. A portable reading material stand including, in combination, a base for supporting the reading material along its lower edges, a backing member fixed to and upstanding from said base, spaced apart means fixed to and extending upwardly from said base and spaced forwardly from said backing member and adapted to maintain the binding of the reading material between the upstanding backing member and said spaced apart means, the pages of the reading material when in operative position extending across the front surfaces of said spaced means, a finger movably mounted on said base relative to said spaced apart means for coaction with each of said spaced apart means and the pages extending thereacross, each of said fingers being biased towards said spaced apart means for releasable engagement with the pages of the reading material, and legs provided for supporting said base, one of said legs extending forwardly from said base and the other of said legs extending rearwardly therefrom, a pair of leg supporting arms extending forwardly from said base and a further pair of leg supporting arms extending rearwardly from said base, each leg supporting arm of said pairs of legs supporting arms being adjustably mounted at the ends of said base for varying the angle of inclination of the legs supporting arms with respect to said base, each leg extending between and pivotally mounted at each end to a pair of legs supporting arms and said base and the components fixed thereto being adjustable on the longitudinal axis of the base to vary the angular position of the base and the reading material mounted thereon with respect to the horizontal and releasable maintaining means is provided extending from each end of said base, one end of each pair of legs supporting arms extending between said releasable maintaining means and each end of said base and clampable therebetween to maintain the legs supporting arms in adjusted positions extended from the base.

* * * * *